US008287395B2

(12) United States Patent
Green et al.

(10) Patent No.: US 8,287,395 B2
(45) Date of Patent: Oct. 16, 2012

(54) INDOOR GOLF GAME AND TRAINING EQUIPMENT

(76) Inventors: Stephen W. Green, New York, NY (US); Aaron J. Rothschild, New York, NY (US)

( * ) Notice: Subject to any disclaimer, the term of this patent is extended or adjusted under 35 U.S.C. 154(b) by 271 days.

(21) Appl. No.: 12/624,136

(22) Filed: Nov. 23, 2009

(65) Prior Publication Data

US 2011/0124427 A1 May 26, 2011

(51) Int. Cl.
*A63B 69/36* (2006.01)

(52) U.S. Cl. ..... 473/172; 473/196; 473/159; 473/278

(58) Field of Classification Search ..... 473/157–167, 473/170–172, 180–197; 220/9.1, 486, 23.8, 220/524
See application file for complete search history.

(56) References Cited

U.S. PATENT DOCUMENTS 1,712,561 A * 5/1929 Jaspert ..... 473/185
1,785,150 A * 12/1930 Soubier et al. ..... 473/137
D142,274 S * 8/1945 Kohen ..... D32/37
3,348,847 A * 10/1967 Fischl ..... 473/262
3,558,140 A * 1/1971 Romeo ..... 473/164
3,584,877 A 6/1971 Florian
3,892,405 A 7/1975 Trevino
3,944,232 A 3/1976 Tierney
4,098,507 A 7/1978 Hudon
4,203,604 A 5/1980 LaGrange
4,211,417 A 7/1980 Brown
4,244,576 A 1/1981 Mosier et al.
4,538,814 A * 9/1985 Cunningham ..... 473/163
4,596,391 A 6/1986 Carolan, Jr.
4,743,026 A 5/1988 Eady
4,877,250 A * 10/1989 Centafanti ..... 473/157
5,039,104 A * 8/1991 Holbrook ..... 473/195
5,042,813 A * 8/1991 Huang ..... 473/153
5,123,651 A * 6/1992 Vinciguerra ..... 473/163
5,354,064 A * 10/1994 Toikka ..... 473/278
5,401,027 A 3/1995 Surbeck
5,407,203 A 4/1995 Jones
5,655,972 A 8/1997 Heitzman
5,733,200 A * 3/1998 Kim ..... 473/161
5,738,594 A 4/1998 Kinney
5,749,789 A * 5/1998 Karl ..... 473/162
5,853,335 A 12/1998 Self
5,984,793 A 11/1999 Palombi
6,106,409 A * 8/2000 Jackson, Jr. ..... 473/278
6,338,682 B1 1/2002 Torchia et al.
(Continued)

*Primary Examiner* — Mark Graham
(74) *Attorney, Agent, or Firm* — Antonio Papageorgiou; Ostrow Kaufman LLP

(57) ABSTRACT

A golf training apparatus is provided that includes one or more components, such as a chipping mat, a putting mat, and a chipping basket. The chipping mat includes a base and at least one section of artificial turf disposed over the base and at least one section of artificial turf includes at least one simulated divot disposed therein. The chipping mat may include a plurality of sections of artificial turf, each simulating a different type of grass found on a golf course, such as the fairway, rough, and deep rough. The putting mat has a section in a first geometric shape that tapers toward or into a section in a second geometric shape smaller than the first geometric shape having the hole disposed therein. The chipping basket has a plurality of sides with at least one of the sides having a variable sized hole disposed therein.

13 Claims, 3 Drawing Sheets

U.S. PATENT DOCUMENTS

| | | | | |
|---|---|---|---|---|
| 6,746,340 | B1 * | 6/2004 | Dover | 473/278 |
| 2003/0078111 | A1 | 4/2003 | Wenzler | |
| 2003/0109325 | A1 * | 6/2003 | Carlton et al. | 473/278 |
| 2005/0197196 | A1 * | 9/2005 | Ostiguy | 473/160 |
| 2005/0197197 | A1 | 9/2005 | Scott | |
| 2006/0199658 | A1 * | 9/2006 | Leonard | 473/197 |
| 2006/0217212 | A1 * | 9/2006 | Sindelar et al. | 473/278 |
| 2007/0042829 | A1 | 2/2007 | Dennesen | |
| 2008/0102968 | A1 * | 5/2008 | Andersen | 473/157 |
| 2009/0181782 | A1 | 7/2009 | Knox | |

* cited by examiner

B-B

INDOOR GOLF GAME AND TRAINING EQUIPMENT

BACKGROUND OF THE INVENTION

The present application relates to the game of golf and more particularly to golf training equipment and related methods of using golf training equipment.

The game of golf is very popular and many training aids have been developed for players to practice off of the golf course. The problem with most training aids, however, is that they do not properly represent the playing conditions on the golf course. Rather, they present a sterile practice environment that does not necessarily prepare a player for the variety of play on the course. Accordingly, there is a need for training aids that better represent true variability of conditions on the course.

SUMMARY OF THE INVENTION

In at least one aspect, a golf training apparatus is provided that includes a chipping mat that comprises a base and at least one section of artificial turf disposed over the base, wherein at least one section of artificial turf includes at least one simulated divot disposed therein. In at least one embodiment, the chipping mat includes a plurality of sections of artificial turf each having grass at a level of height different than a level of height of another of the plurality of sections of artificial turf. In this instance, at least one of the levels of artificial turf has a height that simulates deep rough, which may have a height of about of about 3.5 inches to about 6.5 inches.

In one embodiment, at least one of the levels of artificial turf has a height that simulates rough and the simulated divot is disposed within the section of artificial turf that simulates the rough. The level of artificial turf that simulates the rough may have a height of about of about 1.0 inch to about 3.0 inches. In one embodiment, the simulated divot is a depression within the section of artificial turf that simulates the rough and the depression has an essentially oblong shape with a major dimension of about 3.0 inches to about 5.0 inches and a minor dimension of about 1.5 inches to about 3.5 inches. In another embodiment, the depression extends into the base of the chipping mat and the depression has a least one side with an abrupt transition between the level of artificial turf and the base, and at least one side with a gradual transition between the level of artificial turf and the base.

In one embodiment, the apparatus includes a putting mat that has a section in a first geometric shape and a section in a second geometric shape smaller than the first geometric shape. The first geometric shape tapers toward or into the second geometric shape. In this instance, a hole is disposed within the second geometric shape therein. In one embodiment, the first and second geometric shapes are rectangular, and the first rectangle tapers into the second rectangles with a trapezoidal geometric shape. In one embodiment, the first rectangle has a length of about 66 inches to about 90 inches and a width of about 18 inches to about 42 inches, and the second rectangle has a length of about 2 inches to about 12 inches and a width of about 16 inches to about 26 inches. In one embodiment, the second geometric shape is elevated above the first geometric shape and the first and second geometric shapes interface with an inclined section. In one embodiment, the first geometric section includes a plurality of equally spaced lines along the length of the first geometric section.

In one embodiment, the apparatus includes a chipping basket having a plurality of sides with at least one of the sides having a variable sized hole disposed therein. In one embodiment, the variable size hole is achieved with the chipping basket including a plurality of flaps each hinged at least one end of a side of the basket and removably attached to an opposite end of the side of the basket. In one embodiment, the chipping basket includes at least one major side and the flaps extend along at least one of a length and a width associated with the major side. In one embodiment, the chipping basket has at least three flaps and the hole has an opening of about 21 inches by about 4 inches with one flap opened, an opening of about 21 inches to about 8 inches with two flaps open, and an opening of about 21 inches by about 12 inches with three flaps open.

In one aspect, a method is provided that includes the step or steps of, using a golf club, hitting a golf ball from a chipping mat toward a putting mat a first set of a plurality of times, the first set of the plurality of hits hit during a first hole of a game; determining a score for each of the first set of the plurality of hits based on a proximity of the golf ball to a target after the golf ball is hit; and placing the ball on a position on the putting mat a predetermined distance away from a hole disposed therein based on a total score associated with the first set of the plurality of hits. In one embodiment, chipping mat includes a plurality of sections of artificial turf, each of the sections of artificial turf having a different level of height than another section of artificial turf, the method further including the step or steps of, using a golf club, hitting the golf ball from the chipping mat toward the putting mat a second set of a plurality of times, the second set of the plurality of hits hit in a second hole of a game, determining a score for each of the second set of the plurality of hits based on a proximity of the golf ball to a target after the golf ball is hit, and placing the ball on a position on the putting mat a predetermined distance away from the hole disposed therein based on a total score associated with the second set of the plurality of hits. In this instance, the first set of the plurality of hits are hit from a first of the plurality of sections of artificial turf and the second set of the plurality of hits are hit from a second of the plurality of section of artificial turf. In one embodiment, the second set of the plurality of hits are hit from a simulated divot disposed on the second of the plurality of sections of artificial turf. In one embodiment, the target is a hole in a chipping basket placed over at least a portion of the putting mat. In this instance, the chipping basket includes a plurality of flaps each hinged at least one end of a side of the basket and removably attachable to an opposite end of the side of the basket with at least one flap in an opened position therewith creating the hole in the basket.

In one aspect, a method is provided that includes the step or steps of using the chipping mat in conjunction with the putting mat. Using a golf club, a golf ball is hit from the chipping mat towards the putting mat. This is done a plurality of times determining a total score for the set number of hits. The score is based upon the proximity of the golf ball to the target after being hit. A second plurality of hits is taken from the chipping mat towards the putting mat. The score is totaled in the same manner as the first plurality of hits. This score is then combined with the score from the first plurality of hits in order to determine the position of the golf ball for the next station. The golf ball will be positioned upon the putting mat a distance from a hole disposed therein, determined by the total score.

Additional aspects of the present invention will be apparent in view of the description which follows.

DETAILED DESCRIPTION OF THE INVENTION

Figure 1:
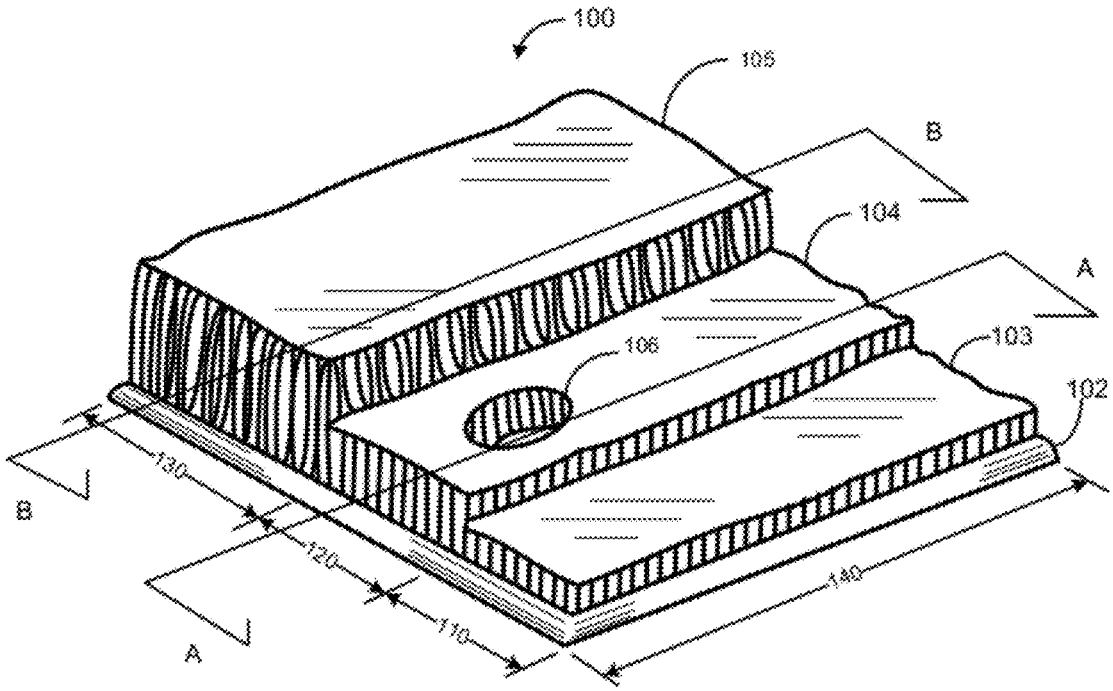
FIG. 1 depicts a chipping mat according to at least one embodiment of the mats disclosed herein.

Referring to FIG. 1, a golf training device according to one embodiment includes a chipping mat 100. The chipping mat 100 generally includes a base 102 with at least one section of artificial turf 103, 104, 105 disposed thereon. The base 102 may be any material capable of withstanding multiple impacts from the head of a golf club, such as a chipping wedge. The base 102, for example, may be the woven synthetic material commonly used as a backing for artificial turf, a dense resilient material, such as synthetic rubber, or a combination thereof. In the latter example, the rubberized material may also provide impact resistance when hit and also serve as a nonskid surface to prevent the mat from moving after each hit.

In at least one embodiment, the mat 100 includes a plurality of sections of artificial turf 103, 104, 105, each having a different level of height than another of the plurality of the sections. The mat may include at least three levels of heights of artificial turf, as shown, each simulating or otherwise representing a particular level of grass found on a golf course. For example, a first level of grass 103 may simulate the grass typically found on the fairway, a second level 104 may simulate the grass typically found in the rough, and a third level 105 may simulate grass typically found in the deep rough. In this respect, the user of the mat, according to this embodiment, may practice chipping or otherwise hitting balls from easy to progressively more difficult playing surfaces. The heights of the grass may vary, but generally the height of the grass for the fairway may be about 1 inch +/−0.5 inch or any increment in between, the height of the grass for the rough may be about 2 inch +/−1.0 inch or any increment in between, and the height of the deep rough may be about 5 inches +/−1.5 inch or any increment in between.

In at least one embodiment, at least one of the sections of artificial turf 103, 104, 105 includes a simulated divot disposed therein 106. The simulated divot 106 is generally a depression within the plane of the playing surface of a section of artificial grass. The depression may be gradual as shown in section 107 of FIG. 2 or it may be abrupt a shown in section 109 of FIG. 2, or a combination thereof. That is, the depression may be abrupt in the sides of the recess 106 that in play would be in the direction of the golf swing and gradual in the leading and trailing edges essentially perpendicular to the direction of the golf swing. The depression may have a depth that is about 10% to about 100%, or any increment in between, of the height of the grass for that particular level. Where the depression is about 100% of the level of the grass, there is generally no grass in the recess 106 or there exists a void within the section of artificial turf allowing the base 102 to show through.

The recess 106 has an overall shape that mimics that of a divot, i.e., generally oblong, e.g., rectangular, elliptical, oval, etc., with the major dimension 202 in the direction of the golf swing. The dimensions of the recess 106 may be about 2.5 inches by about 4 inches, +/−1.0 inch or any increment in between on either dimension. The recess may be disposed biased toward either end of the mat, as shown, or centrally located. The recess 106 is preferably a distance 204 of at least about 2 inches +/−1.0 inch, or any increment in between, from the edge of the mat. The recess 106 generally allows a player to practice hitting balls out of divots found at less than pristine golf courses.

The dimensions of the mat 100 may vary depending on where it is to be used. For example, the mat 100 may be produced for home use. In this instance, a smaller mat having dimensions about 2 ft. by about 2 ft, +/−1.0 foot or any increment in between on either dimension, may be more desirable. For larger spaces, such as at driving ranges, the mat may be about 4.5 ft. by about 4.5 ft, +/−2.0 foot or any increment in between on either dimension. The width 110, 120, 130 and length 140 of each section of artificial turf 103, 104, 105 may vary as well. In one embodiment, each section has a length 140 in the direction of the golf swing that extends nearly the entire length of the mat 100. The width 110, 120, 130 of each section generally depends on the number of sections. For instance, a single level mat will have a width that extends nearly the entire width of the mat 100. A mat with multiple levels will have levels that have widths 110, 120, 130 that are less than the entire width of the mat 100. The width 110, 120, 130 of each of the sections may be equal to each other or they may cover only a percentage of the surface of the mat 100. In one embodiment, the width of at least one of the sections is about 8 inches +/−6.0 inches, or any increment in between. In another embodiment width 110 is about 24, width 120 is about 24 and width 12, +/−10 inches or any increment in between on either dimension.

Figure 2:
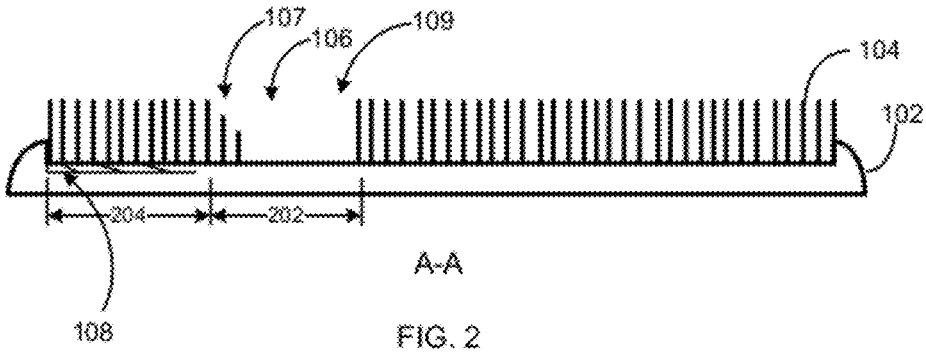
FIG. 2 depicts a cross section of a chipping mat according to at least one embodiment of the mats disclosed herein.

Referring to FIG. 2, a section of artificial turf 104 may be disposed on the base 102 in a variety of ways. For example, the artificial turf 104 may be molded directly into the base 102 or it may be adhered to the base 102 after the base is produced. In the event that an adhesive 108 is used, the adhesive may allow for non-destructive removal of the artificial turf 104 from the base 102 for the installation of replacements sections in the event of damage. Multiple section mats may include separate sections with each section separately removable from the base 102. Alternatively, a plurality of section may be produced as a single carpet or multiple carpets sections may be adhered or sewn together. As noted above, the recess 106 may include a tapered side 107 and an abrupt side 109.

Figure 3:
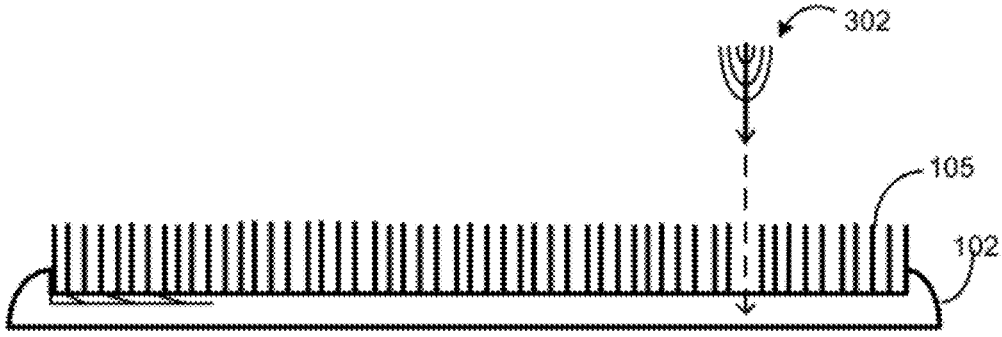
FIG. 3 depicts another cross section of a chipping mat according to at least one embodiment of the mats disclosed herein.

Referring to FIG. 3, a section of artificial turf 105 may also be made of a plurality of individual tufts of synthetic blades of grass 302 disposed on or at least partially within the base 102. For example, the tufts 302 may be adhered to the base 102 or they may be inserted into the base 102. The tuft 302 may include a barb or other means for mechanically securing the tuft 302 inserted into to the base 102. As noted above, one of the sections of artificial turf 105 may have a height that mimics that of grass found in the rough or deep rough. In this instance, the material used for the artificial grass preferably makes the blades of grass sufficiently flexible to perform much like grass yet durable enough to withstand multiple hits from a golf club. The blades of grass may also have a coefficient of friction that mimics that of natural grass in order to provide the feel of hitting a ball in real grass.

Figure 4:
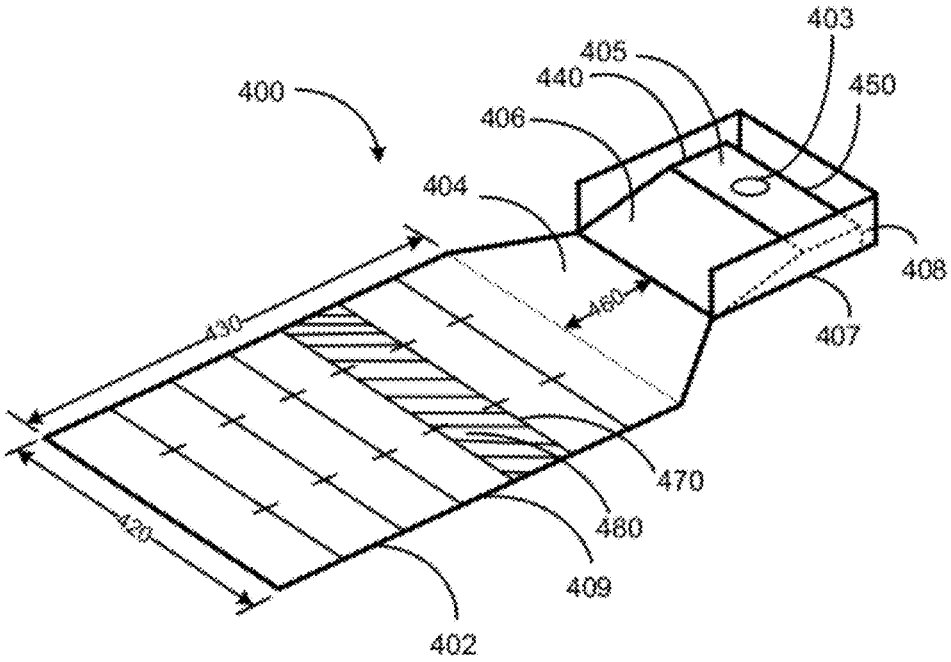
FIG. 4 depicts a putting mat according to at least one embodiment of the mats disclosed herein.

Referring to FIG. 4, the golf training device according to one embodiment includes a putting mat 400. The putting mat 400 generally includes an elongated section of artificial turf 402 that has a surface that simulates the putting green of a golf course. That is, the section 402 includes relatively short lengths of grass spaced together densely. As with the chipping mat 100, the grass may be disposed over a relatively thick resilient base to provide a stable playing environment. The putting mat 400 may also be made to be portable. That is, the base may be sufficiently thin so that section 402 readily folds over itself one or twice, or rolls into a compact storage unit. The mat 400 preferably includes a hole 403 disposed on one end of the mat 400. The hole may be a traditional recessed hole or a simulated hole on the surface.

In one embodiment, the section 402 includes a broad geometric shape 409 that connects to a narrower or smaller geometric shape 405. It is understood that the mat 400 may be made of various and different types of interconnected geometric shapes. In one embodiment, the broad shape 409 is rectangular, and it tapers into a smaller square or rectangular shape 405, via intermediate shape 404, e.g., a trapezoidal shape. In one embodiment, the broad shape 409 has a width 420 of about 30 inches and a length 430 of about 78 inches, +/−1.0 foot or any increment in between on either dimension. The smaller geometric shape 405 may have a width 450 of about 21 inches and a length 440 of about 7 inches, +/−5 inches or any increment in between on either dimension. The intermediary shape 404 may have a length 460 of about 18.5 inches, +/−6 inches or any increment in between.

In one embodiment, at least a portion of the playing surface of the narrower geometric shape 405 is elevated, e.g., about 1 inches +/−1.0 inch or any increment in between, above the playing surface of the broad geometric shape 409. In this instance, the hole 403 may be disposed below the playing surface of the narrower geometric shape 405. Accordingly, in this embodiment an inclined portion 406 exists between or within at least one of the shapes 405, 409, which has a slope of about 1 to about 30 degrees, or any increment in between, preferably less than or equal to about 10 degrees. The inclined portion may have a width of about 21 inches and a length 14 inches, +/−6 inches or any increment in between on either dimension. The narrowing of the mat 400 toward the hole 403 creates a focal point so that after repeated use players will be trained not to easily be distracted on a much larger green at the course. The tapered portion when combined with the incline further creates an obstacle that forces players to concentrate on chipping balls toward the center of the mat 400. Balls hit toward the sides of the mat 400 near the edges of the intermediary shape 406 below the incline would be nearly impossible to sink into the hole 403 in a single putt.

In one embodiment, the putting mat 400 includes at least one perimeter board 407, e.g., one or two side boards, and one back board, that extends around at least a portion of the perimeter of the elevated portion 405 of the mat 400 to prevent the ball from falling off the surface of the elevated portion 405. The perimeter board generally has a height that extends between about 2 to about 4 inches, +/−1 inch or any increment in between on either dimension, above the surface of the elevated portion 405.

The elevated portion 405 may also include a trap 408 or other means for catching balls that have gone long. It is understood that various traps can be added to the putting mat 400. In one embodiment, the trap 408 is an open receptacle that extends around at least a portion of the perimeter, e.g., along the entire length of the backboard, of the elevated section 405. In this respect, the trap 408 may take any shape, including a box like rectangular opening as shown.

Figure 6:
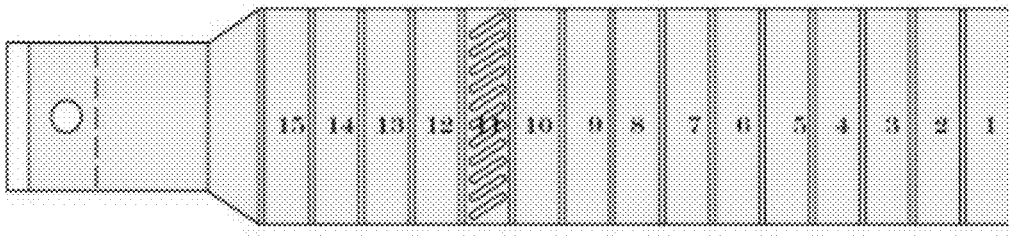
FIG. 6 depicts a putting mat according to at least one embodiment of the mats disclosed herein.

The putting 400 and chipping 100 mats may be used in conjunction to play a simulated game of golf, such as the game or games described herein. In this respect, the putting mat 400 may include markings along the broad geometric shape 409 for scoring and for ball placement purposes. In one embodiment, the mat 400 includes a plurality of lines 470 equally spaced along the length 430 of the mat 400. The lines 470 or preferably the spaces between the lines 470 may be numbered, e.g., from 1 to 15, as shown in FIG. 6. The mat 400 may also include a shaded portion 480 between two lines. The shaded portion 480 may be deemed a par zone as discussed below. The par zone may be disposed at any portion of the broad geometric shape 409, such as at section 11, as shown in FIG. 6.

Figure 5:
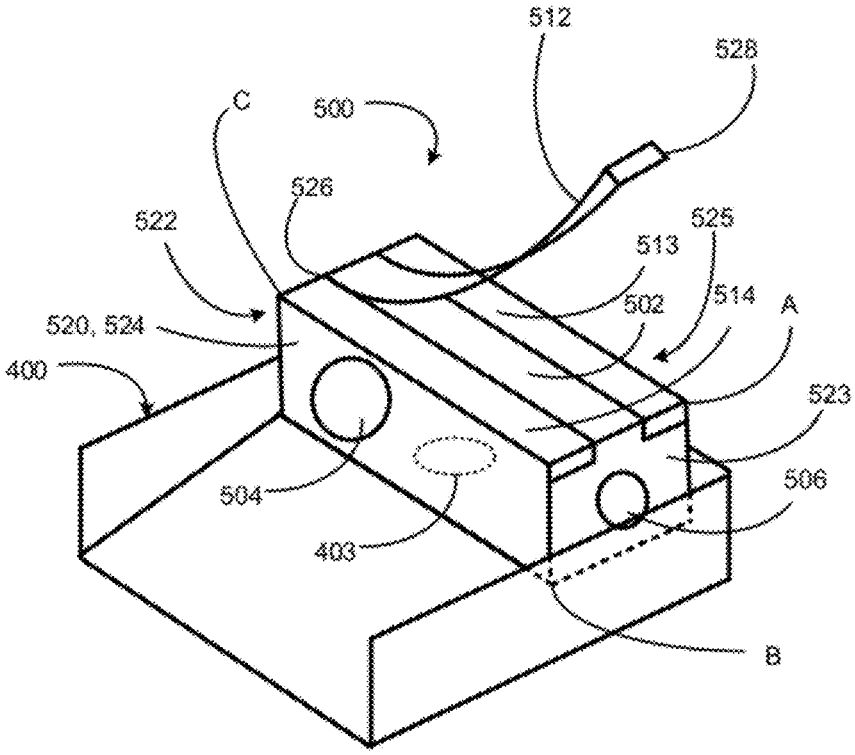
FIG. 5 depicts a chipping basket disposed over a putting mat according to at least one embodiment of the baskets disclosed herein.

Referring to FIG. 5, the golf training device according to one embodiment includes a chipping basket 500. The chipping basket 500 may be made from any material; however, the basket 500 is preferably collapsible for easy storage. This may be accomplished by producing a collapsible wire frame basket with a mesh or any other flexible fabric covering on at least opposing sides of the basket. That is, four rectangular wire frames may be attached together to form four continuous sides 520 of the generally rectangular box shape of the basket 500. The other two sides, e.g., the left 522 and right 523, may be left open or simply covered with the fabric so as not to provide any significant rigidity to the basket in order for the basket to be collapsed by bringing together or pulling apart diagonal corners A and B. Similarly, two of the other sides, such as the front 524 and back 525 may be flexible so that the basket 500 may be collapsed by bringing together or pulling apart diagonal corners B and C. At least one of the flexible sides may be made rigid for use by securing a diagonal brace or an additional rectangular wire frame to the other wire frames.

In at least one embodiment, the basket 500 includes at least one hole 502 that players can use as a target when hitting balls. The basket 500 may include a plurality of holes 502, 504, 506, each having a different size, disposed on other sides of the basket 500. In this respect, players can change the size of the target simply by flipping the basket 500 over so that the desired hole is facing upward. In another embodiment, basket 500 may include at least one side with a variable size hole 502. The variable size of the hole 502 may be accomplished with a cinch cord disposed around the perimeter of a circular hole so that cinching the cord reduces the diameter of the hole and releasing the cord increases the diameter. Alternatively or additionally, the variable size may be accomplished by adding at least one flap that includes a hole thereon that is smaller than a hole on the basket. In this instance, the target may be made smaller by flipping the flap with the smaller hole over the larger hole on the top of the basket 500. Similarly, multiple flaps may be used each with a smaller hole than a previous flap to allow the target to be made progressively smaller.

In at least one embodiment, the basket 500 includes at least one flap 512 that is hinged at one end 526 of the basket 500. In this instance, the hole 502 may be revealed by flipping the flap 512 away from the hole 502 or the hole 502 may be concealed altogether by flipping the flap 512 over the hole 502. The variable size of the hole 502 may be achieved with additional flaps 513, 514, each hinged to at least one end 526 of the basket 500. In use, the hole 502 may be made larger by similarly flipping flaps 513, 514 away from the hole 502 and the hole 502 may be made smaller by flipping flaps 513, 514 over the hole 502. Flaps 512, 513 and 514 may be used alternately or in combination to make the hole 502 progressively smaller or larger. The flaps 512, 513, 514 are shown in FIG. 5 on a major side 524, 525 extending along the major dimension of the basket 500. It is understood that the flaps 512, 513, 514 may also extend in the minor dimension, be disposed on a minor side 523, 542 with the flaps similarly extending in either direction, or a combination thereof. The flaps preferably include a means 528 for securing the flap to the side opposite the flap's hinge, such as a hook and loop, Velcro, etc.

The size of the basket 500 may vary, however, it is preferred that the basket have at least one side dimensioned so that the basket fits over or within the smaller geometric shape 405 of the putting mat 400 as shown. In one embodiment, one side of the basket 500 is about 12 inches by about 21 inches, +/−4 inches or any increment in between on either dimension. The height of the basket may be 12 inches, +/−4 inches or any increment in between. The size of holes may similarly vary. In one embodiment, a hole is about 11½ inches in diameter, +/−4 inches or any increment in between, the hole 504 is about 9 inches in diameter, +/−4 inches or any increment in between, and hole 506 is about 7 inches in diameter, +/−4 inches or any increment in between. As noted above, the different size holes 506, 504, may be disposed on other sides of the basket or on the same side of the basket. The holes may also be other than circular openings. For example, the openings may be rectangular and the rectangular opening may be biased toward either end of a side or centrally located in a side. In one embodiment, the rectangular opening 502 extends at least one of the dimensions of a side. For example, on a 12 inch by 21 inch side, the opening may have at least one dimension that is about 12 inches or about 21 inches. In one embodiment, the rectangular opening has a least one dimension that is about 4, inches +/−2 inches or any increment in between. The rectangular opening may be made larger by opening additional flaps as discussed above. In this instance, opening two flaps would result in a hole 502 about 12 inches by about 8 inches or about 8 inches by about 21 inches, and opening three flaps would result in a hole 502 about 12 inches by about 21 inches. The flaps preferably open independently so that users may open either or a combination of the front, middle, and back flaps.

Novel golf games are also provided herein that may be played with one or more of the components of the golf training device discussed herein. Applicants envision at least seven different ways to play using the components discussed herein. Each of the following games is specifically designed to hone certain elements of the short game (the flop, the bump 'n' run, and the putt). One goal of these games is to improve the player's short game, increase their confidence, and elevate their comfort level when they get to the real golf course.

Standard play: A round of golf can be played with 2-4 players and should take about 15-20 minutes per person. During play, each player will be forced to flop, bump 'n' run, and putt from a variety of lies.

Stroke play: The setup and format is the similar to standard play, except that players count the total number of shots per hole and round and the winner is the player with the least shots per round.

Quick play: A quick round is perfect if you only have a couple of minutes. Quick rounds are also good in that they can accommodate more than 4 people, by playing a tournament. Quick rounds usually take less than 5 minutes per person.

G-O-L-F a.k.a. horseplay: A round of G-O-L-F is best played with 2 players and usually takes less than 15 minutes to complete. G-O-L-F sharpens all 3 elements of the short game and teaches players to be creative and confident.

The following games may also be used specifically to practice either: the flop, the bump 'n' run, or the putt. These games are great for players that do not have a lot of time or just want to work on one element of their short game.

Perfect putter: This game is great for developing and maintaining a consistent putting stroke. It can be played alone or versus another player and takes about 5 to 10 minutes per person.

Bump 'n' run bocce: This game sharpens the golfer's bump 'n' run game all while enjoying the thrills of the ancient game of bocce ball. The game can be played with 2-4 players and takes about 5-10 minutes per round.

Sir flops-a-lot: This game is designed to inspire confidence with the sand wedge. It can be played alone or with up to 4 people. It takes 5-10 minutes per person.

General Set Up: establish a "safe swing zone", unroll the putting mat, and place the chipping mat about 14 feet from the center of the putting hole.

Standard Play

In one embodiment, standard play consists of at least one or preferably three distinctive holes. Each hole is comprised of three separate stations: 1) the flop, 2) the bump 'n' run, and 3) the putt. For the flop, the player must chip the ball from the chipping mat toward a target, such as the chipping basket or the hole. The ball is preferably hit from the fairway section of the chipping mat for at least one of the holes. In other holes, the player may be required to hit from the rough, the deep rough, or the divot. For the bump 'n' run, the player must chip the ball toward the target, such as the chipping basket or the hole, from the chipping mat as well. The ball is preferably hit from the rough or deep rough section of the chipping mat for at least one of the holes. In other holes, the player may be required to hit from the fairway, the deep rough, or the divot.

For at least one or each of the first and second stations, the player hits a ball a plurality of times, such as 6 times, and a score for each hit is recorded. The score for each hit is generally based on how close or the proximity the ball comes to the target after it is hit. A sample scoring scheme is shown below in Table A. For each hole, the total number of points the golfer accumulates during the flop and bump 'n' run stations is determined. This sum of points represents the cumulative accuracy the golfer would have had approaching a real putting green. Thus, the more points a golfer accumulates during the flop and the bump 'n' run stations, the closer their ball would be to the pin or hole. Accordingly, the sum of the points earned for the first and/or second stations determines the placement of the ball on the putting mat for the third station. The player to make the first putt, without their opponent being able to match, wins the hole. The player that wins two out of three holes wins the game.

For standard play, the total number of strokes does not matter; the only thing that matters is who sinks the putt first. Just like in real golf, even if one player has looked far better approaching the putting green, the game is ultimately determined by the putt.

TABLE A

| | | Beginner | Amateur | Pro |
|---|---|---|---|---|
| Flopping | In the Basket | 5 Points | 5 Points | 3 Points |
| | Hit the Basket | 2 Points | 2 Points | 1 Point |
| | Hit the Putting Mat | 1 Point | 1 point | 0 |
| | Ricochet/Bank | 1 Point | 0 | 0 |
| Bump + Run | In the hole | 5 Points | 5 Points | 3 Points |
| | Above the Top Line | 2 Points | 2 Points | 1 Point |
| | Hit the Putting Mat | 1 Point | 1 Point | 0 |
| | Bounce onto the Mat | 1 Point | 0 | 0 |

More experienced players may be handicapped during standard play. That is, players with more experience may be given less points for the same shot a novice player would earn. Alternatively or additionally, the shot may be made more difficult for the experienced player. For example, the experienced player may have to hit toward a smaller target, e.g., a smaller hole in the chipping basket. Similarly, the experienced player may have to putt with shims placed under the putting mat to simulate breaks in the green.

As noted above, the better the cumulative performance in the first and/or second stations, the better the ball placement for the third station. As also noted above, the putting mat may include a plurality of lines. In this instance, the lines may serve as a standard unit of measure for ball placement. It is understood that various scoring/ball placement schemes may be used in accordance with the present disclosure. One scoring/ball placement scheme is shown below in Table B. As can be seen, there is a linear relationship between the scoring scheme and ball placement up to the par zone (section 11). After the par zone, progressively more points are needed to get into the next zone closer to the hole.

TABLE B

| | | |
|---|---|---|
| 1:1 point | 6:6 points | 11:11 points |
| 2:2 points | 7:7 points | 12:15 points |
| 3:3 points | 8:8 points | 16:20 points |
| 4:4 points | 9:9 points | 21:30 points |
| 5:5 points | 10:10 points | 31:50 points |

It is possible that multiple players make their putt on the first hit. In this instance, each player may be required to putt from one putting zone back, e.g., from the hole or from their ball placement position as determined by their cumulative scores. If the players continue to make the putt, they may be required to move back an additional zone until one player sinks the hole while the others miss. Similarly, if both players miss, they may be required to move forward one putting zone until one player sinks the hole while the others miss. Alternatively, the players tied for first place may elect to play any of the three holes over again to determine the winner. If the players disagree on which hole to play, then choose the hole at random.

Each of the three holes is preferably played a little differently. That is, at least one of the stations of one hole is played differently than the same station of another hole. For example, the first station of the first hole may be played with the flop shot hit off the fairway section of the chipping mat. The first station of the second hole may be played with the flop shot hit out of the divot in the chipping mat. And the first station of the third hole may be played with the flop shot hit from the rough section of the chipping mat. An obstacle may also be placed in front of the hole, which requires the player to chip the ball over the obstacle in order for the ball to land on the putting mat. If the game is played indoors, a chair may be used as the obstacle. The second station and third stations may similarly be played differently. For example, the second station of the first hole may be played from the rough, the second station of the second hole may be played from a chipping mat insert, e.g., a collar, the portion of the golf course where the rough meets the fairway, and the second station of the third hole may be played from the played from the fairway and a shim or other substance may be placed under the putting mat to create a hill thereon. The third stations may similarly be made successively more difficult. For example, the first putt may be made on a flat surface, the second putt with a shim placed under and parallel with the par zone, and the third putt with shims, e.g., 1-3 shims, placed under the mat diagonally relative to the lines. Play may also be made different between stations and/or holes with the use of different types of golf balls. For example, both plastic and real golf balls may be played depending on the station. The Flop and the bump 'n' run stations may use plastic golf balls, whereas the putting station may use a real ball.

Stroke Play

The setup and format of stroke play is similar to standard play. As in standard play, there are 3 holes, and each hole has 3 separate stations. The objective of stroke play is to complete the holes in as few strokes as possible. The player with the least strokes is the winner.

Generally, each player records how many shots it takes to complete the first hole, which includes the total number of flops to accumulate 7 points, the total number of bump 'n' runs to accumulate 7 points, and the total number of attempts it takes to make a putt from the par zone. If the player misses a putt, the player may be allowed to move up one putting zone until the player makes the putt. Each player then records how many shots it takes to complete the second and third holes and the total number of shots for all three holes is determined.

Quick Play

Quick play allows players to increase the speed of the game. The rules are similar to stroke play, with the following differences: a player only needs to accumulate 5 points on the flop, 5 points on the bump 'n' run, and the first putt is taken from the par zone.

Any one of the games discussed herein may be played in a tournament. A tournament may be played as heads up, where the winner of each player pair advances to the next round (no matter what their score was) and continues until all but one player is eliminated. Another way to play a tournament is points style, where only the players with the best scores advance to the next round. In points style, the number of players that advance can be determined by allowing the top X scores to advance to the next round (X can be 2, 3, 10, or whatever number the players have chosen), or to have all players that score X or better advance to the next round (again, X can represent whatever score the golfers have chosen). In the points type tournament, any number of golfers can advance to the next round.

Horse Play (G-O-L-F)

The rules of "Horse Play" are simple and similar to the basketball game "H-O-R-S-E." That is, the first player to receive all the letters G-O-L-F loses the game. A player receives a letter if they are unable to match the controlling opponent's shot. For example, if player 1 makes a putt from 5 feet, player 2 gets a letter if he is unable to make the same putt. If player 2 makes the putt, player 1 retains control and dictates a new shot, e.g., either a bump 'n' run, flop, or putt from another area. If player 1 misses the next shot, player 2 gains control, which allows player 2 to dictate the next shot, e.g., putt, flop, or bump 'n' run. Player 2 must then make the next shot and player 1 must miss the same shot to receive a letter.

Generally, the player in control has complete freedom to attempt any shot they desire. Furthermore, the player in control can specify any banks, bounces, or ricochets that the ball has to achieve before reaching its intended target. If the player in control chooses to do a flop shot, they can move the chipping mat and/or the basket to a new location. The player in control may also place obstacles in the way of a shot if desired, create hills or breaks in the putting mat, etc. The only restriction on the controlling player may be that the controlling player must force his or her opponent to get at least one letter from each type of shot, e.g., a bump 'n' run, a flop, and a putt. How the controlling player makes his or her opponent receive the final letter is up to them. This restriction, if implemented, prevents a very good putter or chipper from dominating the game with one type of shot. It is also useful in that the restriction encourages honing all three aspects of the short game.

Perfect Putter

This is a great game to practice your putting. It can be played alone or with multiple people. The objective is very easy, sink a putt from every putting zone with the least amount of missed putts possible. A player generally starts at the putting zone closest to the hole and moves to a putting zone farther from the hole each time a putt is made. The player repeats from each putting zone, however, fewer than all of the putting zones may be played to shorten the length of the game. In this instance, the player records the number of missed shots. If the player did not miss any putts, then the player's score would be 1. Another player may then get a chance to play in the same way and the player with the smallest score overall would win. Obstacles, undulations, breaks, etc. may be introduced into the putting mat to make play more difficult.

Sir Flops-a-Lot

Sir flops-a-lot is a great game that teaches players to become accustomed to all the different lies a flop shot can be taken from (fairway, rough, and divot). Sir flops-a-lot can be played alone to practice, or versus opponents for fun. Generally, a plurality of shots are taken for each of at least two different sections of the chipping mat and the score is tabulated to determine the winner. For example, 6 shots may be made from the fairway section, 6 shots may be made from the rough section, and 6 shots may be made from the divot. The scores for each shot may be tabulated and the player with the best score wins.

Bocce Golf or Bump 'n' Run Bocce

This is a fun way to practice one of the most awkward shots in golf, the bump 'n' run. Bocce Golf or Bump 'n' Run Bocce is played with 8 or any other number of wiffle golf balls and 1 smaller ball called the pallino. The purpose of the game is for the player to hit his golf balls as close as possible to the pallino. The game is best played with 2 or 3 people. Each player will preferably use a set of balls that are unique for that player so that the balls are readily identifiable, e.g., with marks, colors, etc., from balls assigned to other players.

The game generally begins with a player throwing the pallino onto the putting mat. After the pallino is thrown, the first player will bump 'n' run or chip his or her first shot toward the pallino. After the first player has hit his or her first ball, he is considered "inside" because the first player's ball at that time is closest to the pallino than any other ball. All other players are considered "outside". When a player becomes an inside player, he or she forfeits his next turn to allow an outside player to hit balls towards the pallino until the outside player either exhausts his or her supply of golf balls or until the outside player becomes an inside player. After all players have hit all their golf balls, the inside player at the end of the round will be awarded points, e.g., one point for every ball that is closer to the pallino than a competitor's ball. Another round may be played with a different player throwing the pallino onto the mat. A game is generally won when a player reaches 13 or any other number of points. Multiple rounds are played until a player reaches the desired point level. Of course, this point level can be decreased or increased depending on time constraints. Although this game was discussed in relation to the bump 'n' run, it is applicable to putting as well. That is, players may putt from the zone farthest away from the hole toward the pallino.

While the foregoing invention has been described in some detail for purposes of clarity and understanding, it will be appreciated by one skilled in the art, from a reading of the disclosure, that various changes in form and detail can be made without departing from the true scope of the invention in the appended claims.

What is claimed is:

1. A golf training apparatus comprising:

a chipping mat that comprises:

a base; and at least one section of artificial turf disposed over the base, wherein the at least one section of artificial turf includes at least one simulated divot disposed therein;

a putting mat that comprises a section having a first geometric shape and a section having a second geometric shape smaller than the first geometric shape, and wherein the first geometric shape tapers toward the second geometric shape and a hole is disposed in the second geometric shape;

a chipping basket having a plurality of sides, wherein at least one of the sides has a variable sized hole disposed therein, the at least one of the sides comprising a plurality of flaps each hinged at at least one end of a side of the basket and removably attached to an opposite end of the side of the basket.

2. The apparatus of claim 1, wherein the chipping mat comprises a plurality of sections of artificial turf each having grass at a level of height different than a level of height of another of the plurality of sections of artificial turf, wherein at least one of the levels of artificial turf has a height that simulates deep rough.

3. The apparatus of claim 2, wherein the level of artificial turf that simulates deep rough has a height of about of about 3.5 inches to about 6.5 inches.

4. The apparatus of claim 2, wherein at least one of the levels of artificial turf has a height that simulates rough and wherein the simulated divot is disposed within the section of artificial turf that simulates the rough.

5. The apparatus of claim 4, wherein the level of artificial turf that simulates the rough has a height of about of about 1.0 inch to about 3.0 inches.

6. The apparatus of claim 4, wherein the simulated divot is a depression within the section of artificial turf that simulates the rough and wherein the depression has an essentially oblong shape with a major dimension of about 3.0 inches to about 5.0 inches and a minor dimension of about 1.5 inches to about 3.5 inches.

7. The apparatus of claim 6, wherein the depression extends into the base of the chipping mat and wherein the depression has a least one side with an abrupt transition between the level of artificial turf and the base, and at least one side with a gradual transition between the level of artificial turf and the base.

8. The apparatus of claim 1, wherein the first and second geometric shapes are rectangular, and wherein the first rectangle tapers into the second rectangle in a trapezoidal geometric shape.

9. The apparatus of claim 8, wherein the first rectangle has a length of about 66 inches to about 90 inches and a width of about 18 inches to about 42 inches, and wherein the second rectangle has a length of about 2 inches to about 12 inches and a width of about 16 inches to about 26 inches.

10. The apparatus of claim 8, wherein the second geometric shape is elevated above the first geometric shape, and wherein the first and second geometric shapes interface with an inclined section.

11. The apparatus of claim 8, wherein the first geometric section comprises a plurality of equally spaced lines along the length of the first geometric section.

12. The apparatus of claim 1, wherein the chipping basket comprises at least one major side and wherein the flaps extend along at least one of a length and a width associated with the major side.

13. The apparatus of claim 12, wherein the chipping basket comprises at least three flaps and wherein the hole has an opening of about 21 inches by about 4 inches with one flap opened, an opening of about 21 inches to about 8 inches with two flaps open, and an opening of about 21 inches by about 12 inches with three flaps open.

* * * * *